US007380333B2

(12) United States Patent
Tsukada et al.

(10) Patent No.: US 7,380,333 B2
(45) Date of Patent: Jun. 3, 2008

(54) CHIP RESISTOR FABRICATION METHOD

(75) Inventors: Torayuki Tsukada, Kyoto (JP); Takahiro Kuriyama, Kyoto (JP)

(73) Assignee: Rohm Co., Ltd., Kyoto (JP)

( * ) Notice: Subject to any disclaimer, the term of this patent is extended or adjusted under 35 U.S.C. 154(b) by 85 days.

(21) Appl. No.: 10/121,715

(22) Filed: Apr. 15, 2002

(65) Prior Publication Data

US 2002/0148106 A1 Oct. 17, 2002

(30) Foreign Application Priority Data

Apr. 16, 2001 (JP) ..... 2001-116511

(51) Int. Cl.
*H01C 17/00* (2006.01)

(52) U.S. Cl. ..... 29/610.1; 29/417; 29/830; 29/832; 264/272.14; 438/15; 438/118

(58) Field of Classification Search ..... 29/610.1, 29/417, 830, 832; 438/15, 118; 264/272.14
See application file for complete search history.

(56) References Cited

U.S. PATENT DOCUMENTS 6,080,602 A * 6/2000 Tani et al. ..... 438/114
6,153,256 A 11/2000 Kambara et al. ..... 427/103
6,304,167 B1 * 10/2001 Nakayama ..... 338/195
6,344,162 B1 * 2/2002 Miyajima ..... 264/272.14
6,368,893 B1 * 4/2002 Tani et al. ..... 438/106
6,495,379 B2 * 12/2002 Iketani ..... 438/15

FOREIGN PATENT DOCUMENTS

| | | | |
|---|---|---|---|
| JP | 02-010879 | | 1/1990 |
| JP | 08-102454 | | 4/1996 |
| JP | 10-321421 | | 12/1998 |
| JP | 11-087102 | | 3/1999 |
| JP | 11-224802 | | 8/1999 |
| JP | 11-307323 | | 11/1999 |
| JP | 2000-068104 | | 3/2000 |
| JP | 2002-050591 | * | 2/2002 |

OTHER PUBLICATIONS

Japanese Office Action mailed Oct. 24, 2006.
English language Abstracts of JP 02-010879; 10-321421; 11-087102; 11-224802; 11-307323; 2000-068104.

* cited by examiner

*Primary Examiner*—Thiem Phan
(74) *Attorney, Agent, or Firm*—Michael Bednarek; Paul, Hastings, Janofsky & Walker LLP

(57) ABSTRACT

A method of making a chip resistor is provided. The method includes the following steps. First, a resistive element is provided on a substrate. Then, a resin layer is formed on the substrate to enclose the resistive element. Then, the substrate and the resin layer are cut in this order. To prevent the breakage of the substrate during the cutting, the resin layer has better machinability than the substrate.

6 Claims, 15 Drawing Sheets

CHIP RESISTOR FABRICATION METHOD

CROSS REFERENCE TO RELATED DOCUMENT

The present application claims the benefit of Japanese Application 2001-116511, which was filed on Apr. 16, 2001.

BACKGROUND OF THE INVENTION

1. Field of the Invention

The present invention relates to a fabrication method of a chip resistor of surface-mounting type.

2. Description of the Related Art

Recently, surface-mounting electronic devices have been widely used in order to improve the mounting density. FIG. 18 of the accompanying drawings shows a typical example of a conventional chip resistor. The resistor (generally indicated by the numeral 100) includes an insulating substrate 1, a first electrode 2*a*, a second electrode 2*b*, a resistive layer 3, an overcoat 4 and an undercoat 5. The first electrode 2*a*, identical to the second electrode 2*b*, is composed of an upper conductor 21*a*, an auxiliary conductor 21*b*, a lower conductor 22 and a side conductor 23.

A plurality of resistors 100 are produced efficiently by employing a collective production technique (whereby identical resistors are simultaneously obtained from a single mother substrate). Specifically, several elements, such as electrodes, resistive layers and protection covers, are prearranged on a common substrate. Then, the substrate is divided into smaller pieces along prescribed cut lines by a dicing cutter for example.

In accordance with the conventional method, however, it is difficult to cut the mother substrate properly, and unwanted burrs often result in the cut surface of the substrate, as will be described below.

Specifically, referring to FIGS. 19A and 19B, a mother substrate 10 is to be cut by a dicing cutter D. As illustrated, the substrate 10 is provided with a prescribed number of resistive layers 3, undercoats 5, overcoats 4, etc. The substrate 10 is fixed to an adhesive sheet 9 on a work table T. The adhesive sheet 9 is composed of a base 91 and an adhesive layer 92.

To cut the substrate 10, as shown in FIG. 19A, the dicing cutter D is urged downward by a certain pressure. Upon the pressure application, the dicing cutter D exerts a lateral force F (and forces of other directions) on the substrate 10. Conventionally, as the cutting proceeds and the local thickness of the substrate 10 is reduced to a certain value $\alpha$ (25 μm for example), the substrate 10 will be broken by the lateral force F, as shown in FIG. 19B. Though the substrate 10 is attached to the adhesive sheet 9, the sheet 9 is not strong enough to prevent the breakage of the substrate 10. Due to the improper cutting result, an unwanted burr 111*a* will be left at the cut surface of the conventional substrate.

SUMMARY OF THE INVENTION

The present invention has been proposed under the circumstances described above. It is, therefore, an object of the present invention to provide a fabrication method of chip resistors that does not suffer from a burr at a cut surface.

According to a first aspect of the present invention, there is provided a method of making a chip resistor that includes the steps of: providing a resistive element on a substrate; forming a resin layer on the substrate to enclose the resistive element; and cutting the substrate and the resin layer in this order. To prevent the breakage of the substrate at the cutting step, the resin layer has better machinability than the substrate.

Preferably, the resin layer may have a thickness in a range of 20~100 μm.

Preferably, the method of the present invention may further include the step of attaching the resin layer to an adhesive sheet before the cutting step.

According to a second aspect of the present invention, there is provided a method of making a chip resistor that includes the steps of: attaching a first mother substrate to a second mother substrate having better machinability; forming a resistive element on the first mother substrate; and cutting the first mother substrate and the second mother substrate in this order. Preferably, the second mother substrate may have a thickness in a range of 20~100 μm.

Preferably, the first mother substrate may be provided with a plurality of areas defined for formation of resistive elements.

Preferably, the method of the present invention may further include the step of attaching the second mother substrate to an adhesive sheet before the cutting step.

Preferably, the second mother substrate may be made of aluminum nitride or forsterite.

According to a third aspect of the present invention, there is provided a method of making a chip resistor that includes the steps of: attaching an insulating substrate and a conductor to each other; forming a resistive element on the substrate; and cutting the substrate and the conductor in this order. The conductor has a thickness in a range of 20~100 μm.

Other features and advantages of the present invention will become apparent from the detailed description given below with reference to the accompanying drawings.

DETAILED DESCRIPTION OF THE PREFERRED EMBODIMENT

Preferred embodiments of the present invention will be described below with reference to the accompanying drawings.

Figure 1:
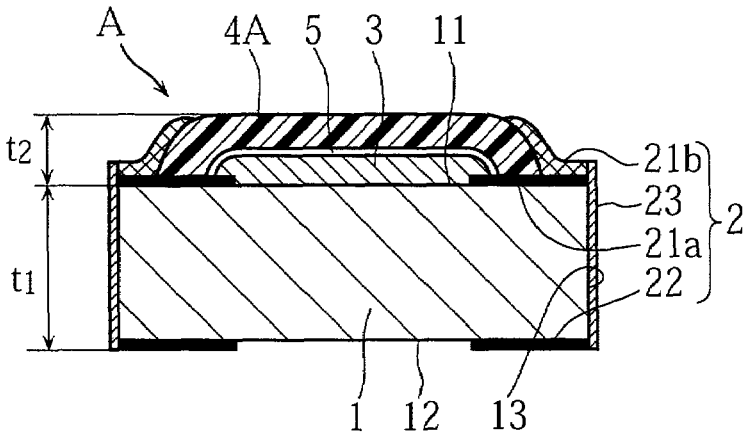
FIG. 1 is a sectional side view showing the basic structure of a chip resistor according to a first embodiment of the present invention.

FIG. 1 shows the basic structure of a chip resistor (generally indicated by the reference A) according to a first embodiment of the present invention. The resistor A, which is a surface-mounting type, includes a substrate 1 made of alumina ceramic. In the illustrated example, the thickness t1 of the substrate is about 0.18 mm. In plan view (not shown), the length of the substrate 1 is about 0.6 mm and the width is about 0.3 mm. The substrate 1 is provided with a pair of electrodes 2 each of which is disposed at an end of the substrate 1. A resistive layer 3 is formed on the upper surface of the substrate, bridging between the two electrodes 2.

As shown in FIG. 1, each electrode 2 is composed of a first upper conductive layer 21*a* (formed on the upper surface 11 of the substrate 1), a lower conductive layer 22 (formed on the lower surface 12 of the substrate 1), a second upper conductive layer 21*b* (formed on the first upper conductive layer 21*a*) and a side conductive layer 23 (formed on the side surface 13 of the substrate 1). The first upper conductive layer 21*a* and the lower conductive layer 22 may be formed from gold or silver to a thickness between 7 μm and 15 μm for example. The second upper conductive layer 21*b* may be made of a conductive resin (containing e.g., silver particles) and serves as an auxiliary conductive member for the first upper conductive layer 21*a* (that is directly connected to the resistive layer 3). The side conductive layer 23 may be made of gold or silver and connects the upper conductive layers 21*a*, 21*b* to the lower conductive layer 22. Though not shown, a nickel-plating layer and a solder-plating layer are formed to cover the second upper conductive layer 21*b*, the lower conductive layer 22 and the side conductive layer 23.

The resistive layer 3 may be made of a metal or a metal oxide so that the layer 3 has required electrical characteristics. As will be descried later, the resistive layer 3 is formed with a trimming groove for adjusting the resistance of the layer. This groove may be made by laser processing.

An undercoat 5 made of glass is formed on the resistive layer 3. The undercoat 5 is provided for preventing the resistive layer 3 from being damaged by the formation of the trimming groove.

Further, an overcoat 4A is formed on the undercoat 5. The overcoat 4A protects the resistive layer 3 provided with the trimming groove. The overcoat 4A may be made of a resin having a smaller hardness than the substrate 1, so that the overcoat 4A is easier to be processed. The thickness $t_2$ of the overcoat 4A may be 20~100 μm (preferably 25~50 μm).

Next, a fabrication method of the resistor A will be described with reference to FIGS. 2~10. According to this method, a number of resistors identical to the resistor A are obtained from a single mother substrate.

Figure 2:
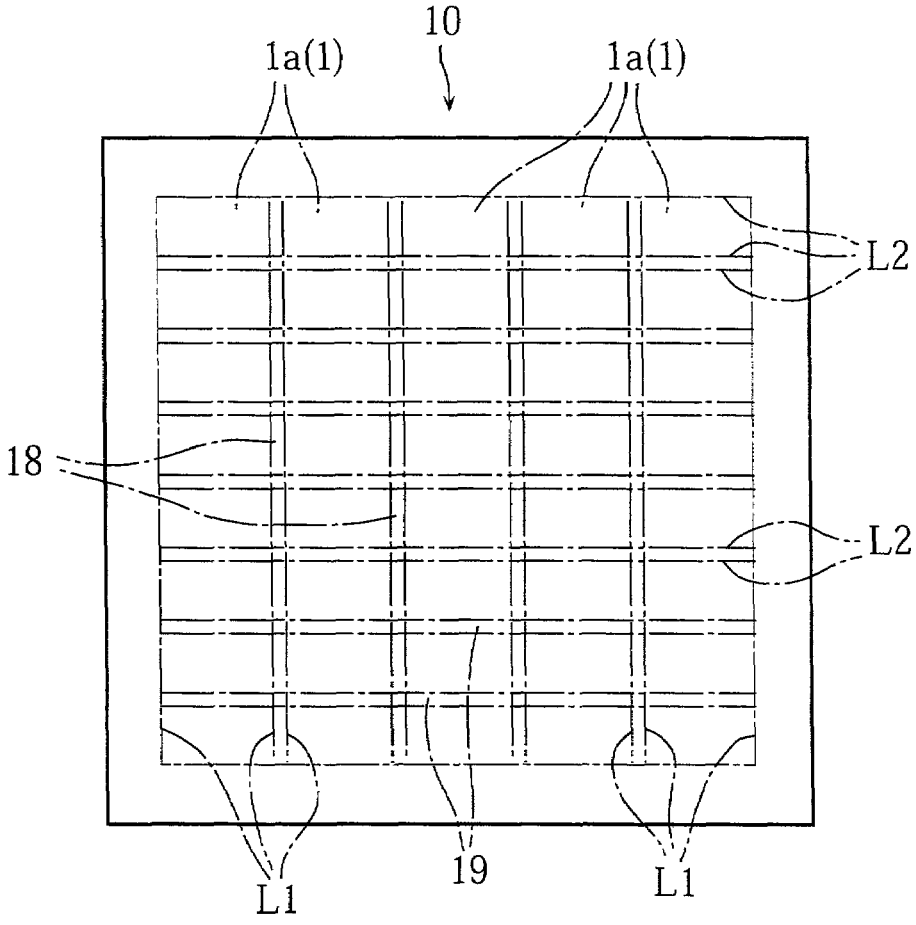
FIG. 2 is a plan view showing a mother substrate used for collective formation of the resistor of FIG. 1.

First, a mother substrate 10 as shown in FIG. 2 is prepared. The mother substrate 10, which may be made of alumina ceramic, is provided with a plurality of rectangular areas 1*a* defined by first cut lines L1 and second cut lines L2. The first cut lines L1 are parallel to each other. The second cut lines L2 are parallel to each other and perpendicular to the first cut lines L1. The rectangular area 1*a* corresponds to the substrate 1 of the resistor A (FIG. 1). In FIG. 2, the reference numerals 18 and 19 refer to surplus portions of the substrate 10 that are to be removed when the substrate 10 is divided along the cut lines L1 and L2. These portions are usually called "streets."

Figure 3:
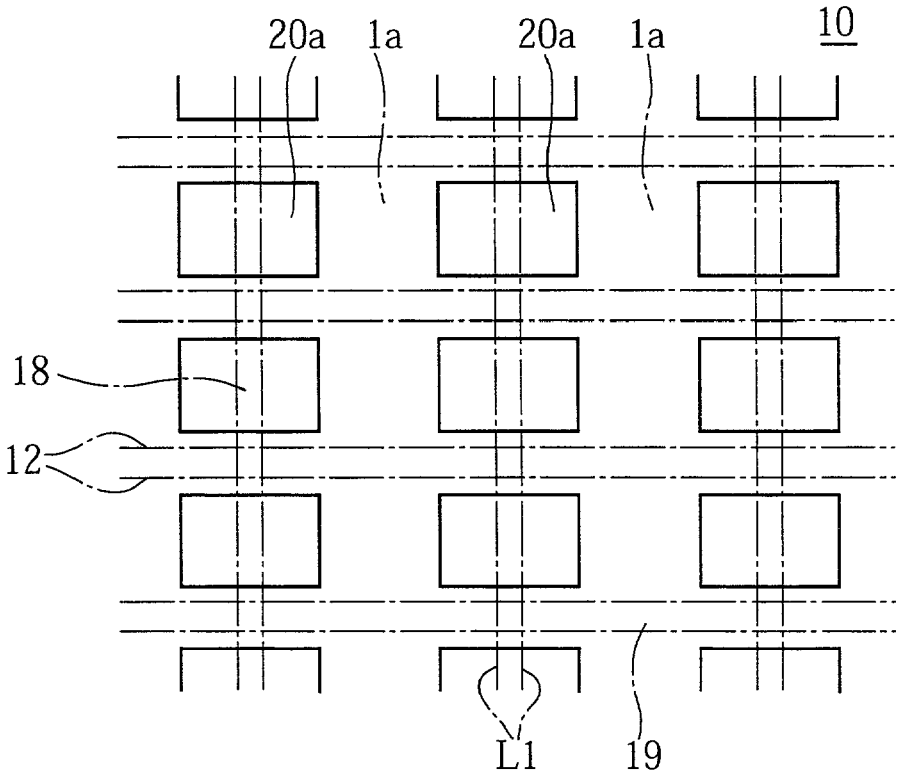
FIGS. 3-9, 10A-10C illustrate steps of a method of making the resistor of FIG. 1.

Then, as shown in FIG. 3, a first upper conductive pattern is formed on the substrate 10. This pattern is composed of a plurality of rectangular conductive pieces 20*a*. As seen from below, the conductive piece 20*a* is processed to serve as the first upper conductive layer 21*a* shown in FIG. 1. Each conductive piece 20*a* intersects the relevant surplus portion 18, bridging between the adjacent areas 1*a*.

The first upper conductive pattern may be formed by a screen printing method. Specifically, a netting screen (formed with openings corresponding to the upper conductive pattern) is laid over the mother substrate 10. Then, conductive paste (containing gold or silver particles) is forced onto the mother substrate 10 through the screen with the use of a squeegee. The screen is then removed, and the applied paste is dried. Finally, the paste is baked to produce the desired upper conductive pattern as shown in FIG. 3. Though not shown in the figures, a lower conductive pattern is formed on the opposite surface of the mother substrate 10 in the same manner. The lower conductive pattern is composed of a plurality of conductive pieces corresponding to the lower conductive layers 22 shown in FIG. 1.

Figure 4:
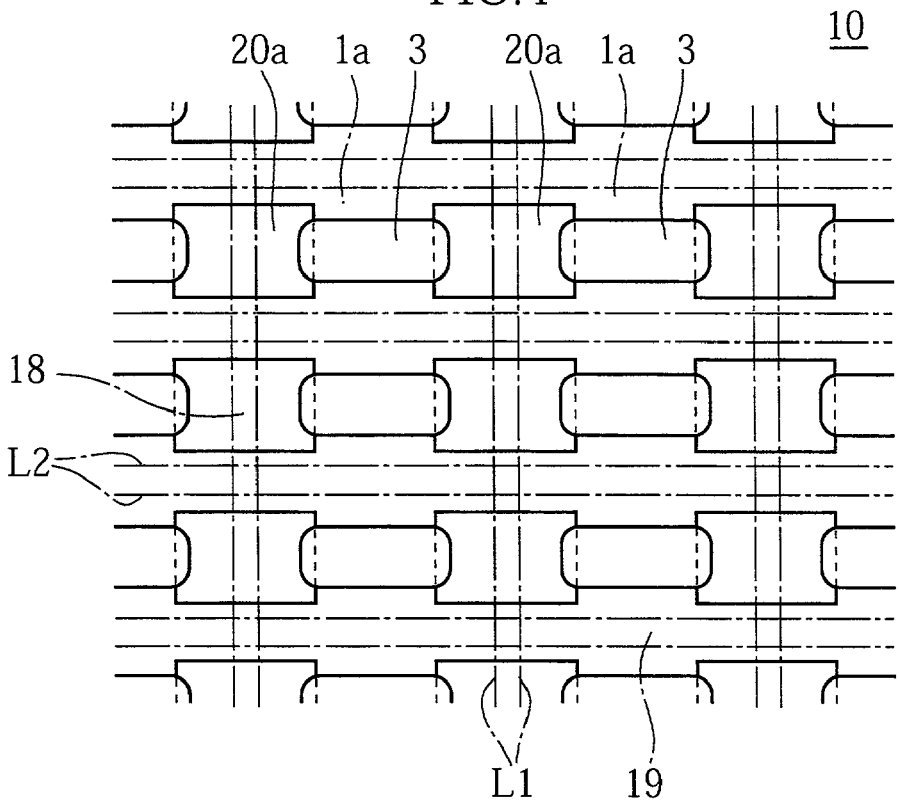

Then, as shown in FIG. 4, a resistive layer 3 is formed on the upper surface of each area 1*a*. The resistive layer 3 bridges between the adjacent conductive pieces 20*a*. The resistive layer 3 may be made by a screen printing method. Specifically, a resistive paste having desired electric characteristics is prepared by adding metal to glass frit. Then, the paste is applied onto the mother substrate 10 through the screen, and finally the applied paste is baked.

Figure 5:
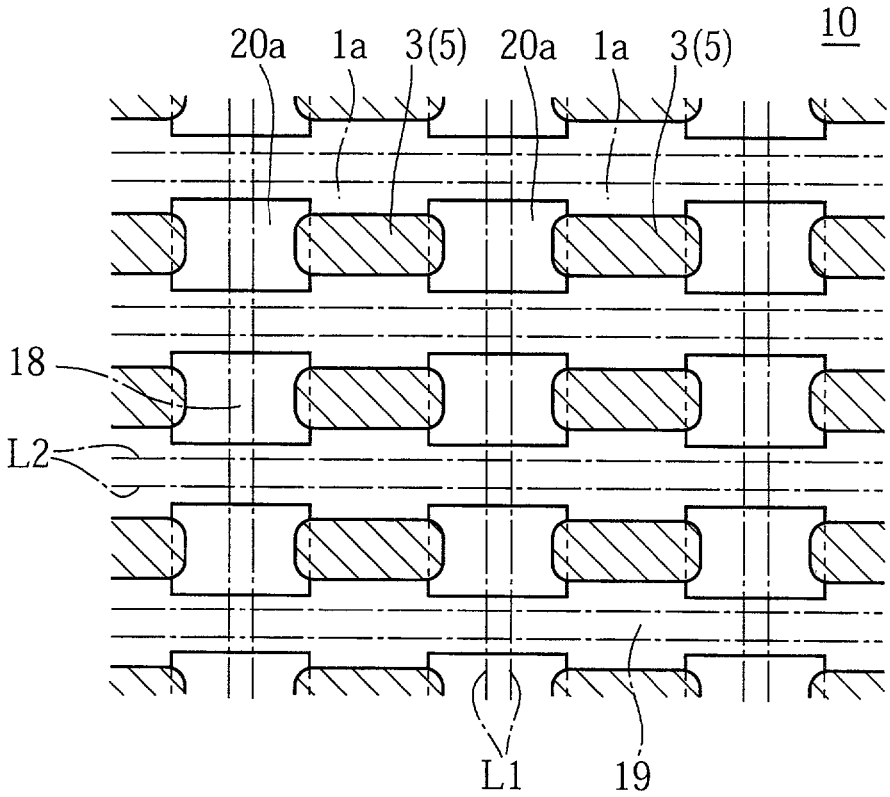

Then, as shown in FIG. 5, each resistive layer 3 is covered by an undercoat 5 produced by printing and baking of glass-containing, insulating paste.

Figure 6:
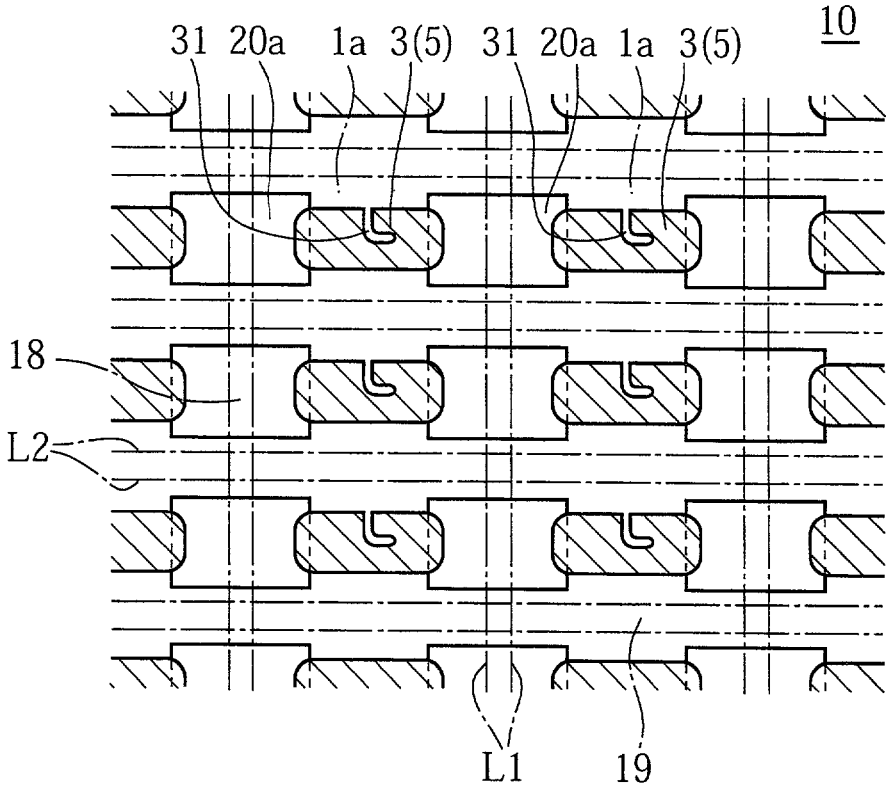

Then, as shown in FIG. 6, each resistive layer 3 is subjected to laser trimming for adjustment of resistance. Specifically, while the trimming is being performed, the current resistance of the resistive layer 3 is monitored with probes held in contact with the relevant conductive pieces 20*a*. As a result, an L-shaped trimming groove 31 for example is formed in the resistive layer 3 and the associated undercoat 5. After the trimming is finished, the mother substrate 10 is washed to remove the remnants resulting from the trimming.

Figure 7:
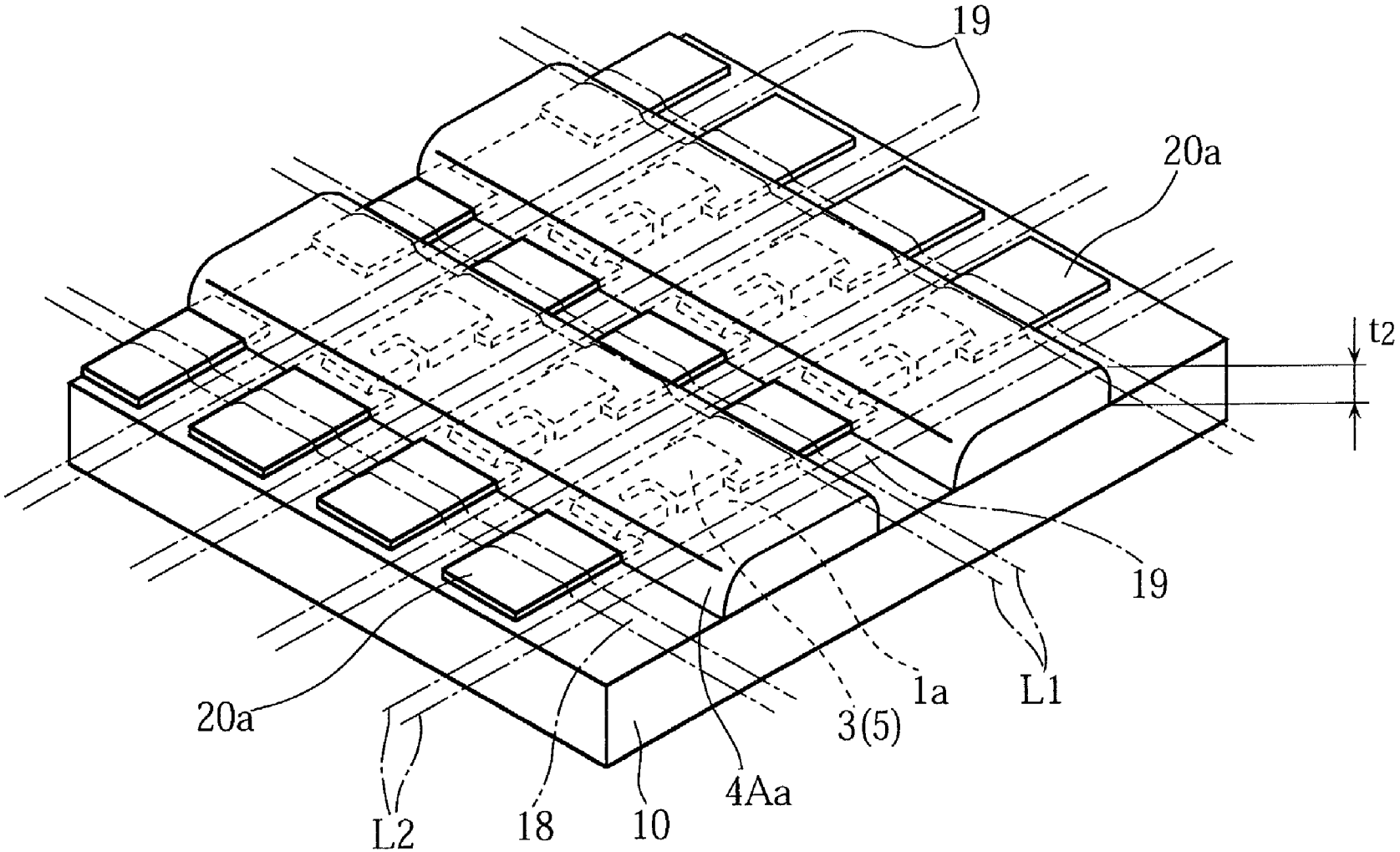

Then, as shown in FIG. 7, resin layers 4Aa (the prototype of the overcoat 4A shown in FIG. 1) are formed on the mother substrate 10. Each layer 4Aa extends along the cut lines L1, covering the resistive layers 3 (precisely the undercoat 3) adjacent in this direction. As seen from the figure, the resin layers 4Aa intersect the surplus portions 19 of the mother substrate 10.

The respective resin layers 4Aa may be formed simultaneously by screen printing. The thickness $t_2$ of each resin layer 4Aa may be 20~100 μm, preferably 25~50 μm. Since the thickness t2 corresponds to the thickness of the screen, it can be varied by changing the thickness of the screen.

Figure 8:
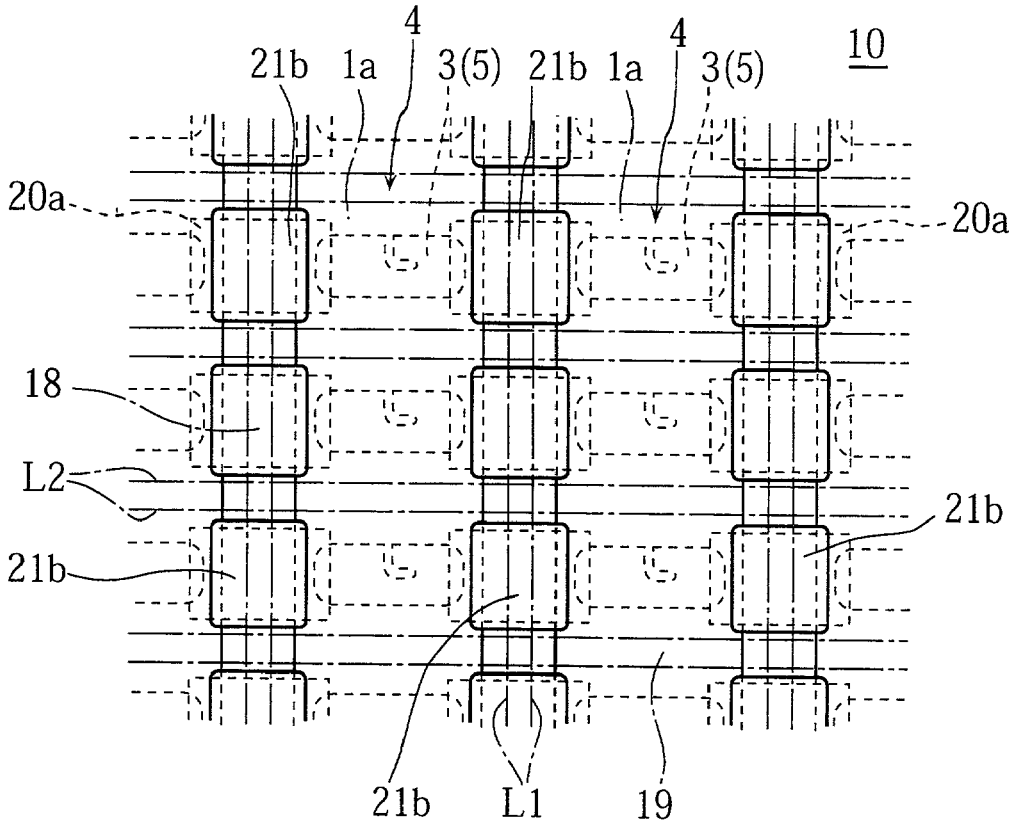

Then, as shown in FIG. 8, a second upper conductive pattern (composed of a plurality of conductive pieces 21*b*) is formed. Each conductive piece 21*b* is held in contact with a portion of the first upper conductive pattern that is not covered by the resin layers 4Aa. The second upper conductive pattern may also be formed by screen printing from a conductive resin paste containing silver and glass particles.

Then, the mother substrate 10 is cut along the cut lines L1 (primary cutting) by using a dicing cutter. The dicing cutter is provided with a "blade" or whetstone containing diamond abrasive, and may have a thickness of about 40 μm and a diameter of about 50 mm.

Figure 9:
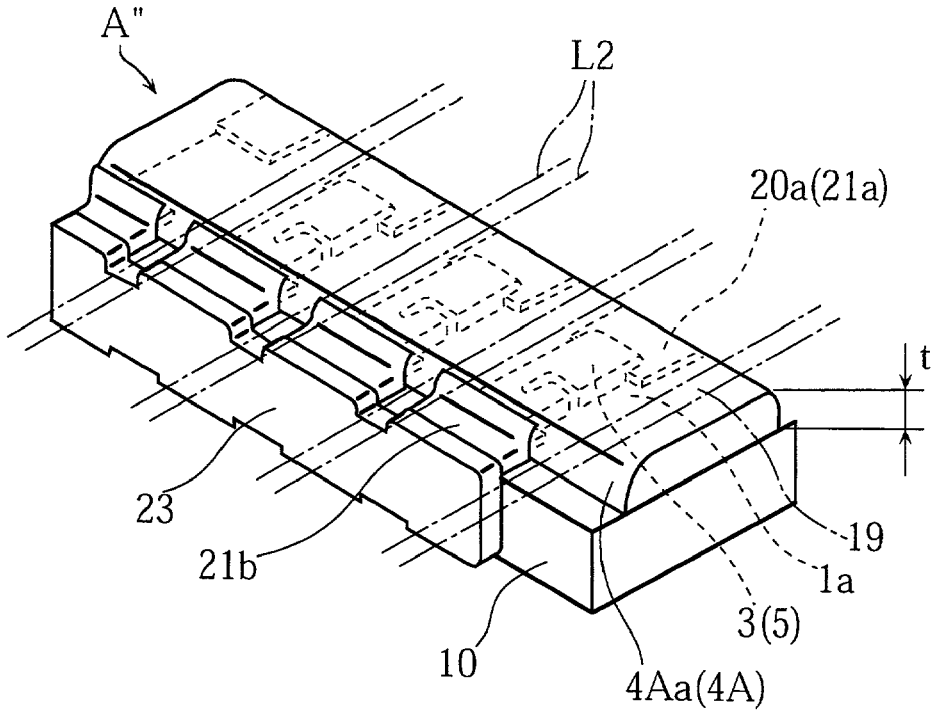

As a result of the cutting, an intermediate form A" shown in FIG. 9 is obtained. Then, a side conductive layer 23 is formed on each of the cut surfaces of the intermediate form A". The layer 23 is connected to both the upper conductive patterns 21*a*, 21*b* and the lower conductive pattern 22. The layer 23 may be made by printing and baking the conductive paste applied onto the cut surface.

Then, the intermediate form A" is cut along the cut lines L2 (secondary cutting), to provide individual chips corresponding to the respective areas 1*a*. Finally, the exposed portions of the second upper conductive layer 21*b*, the lower conductive layer 22 and the side conductive layer 23 are nickel-plated and solder-plated. Thus, identical resistors shown in FIG. 1 are obtained.

Details of the secondary cutting will now be described below.

Figure 10A:
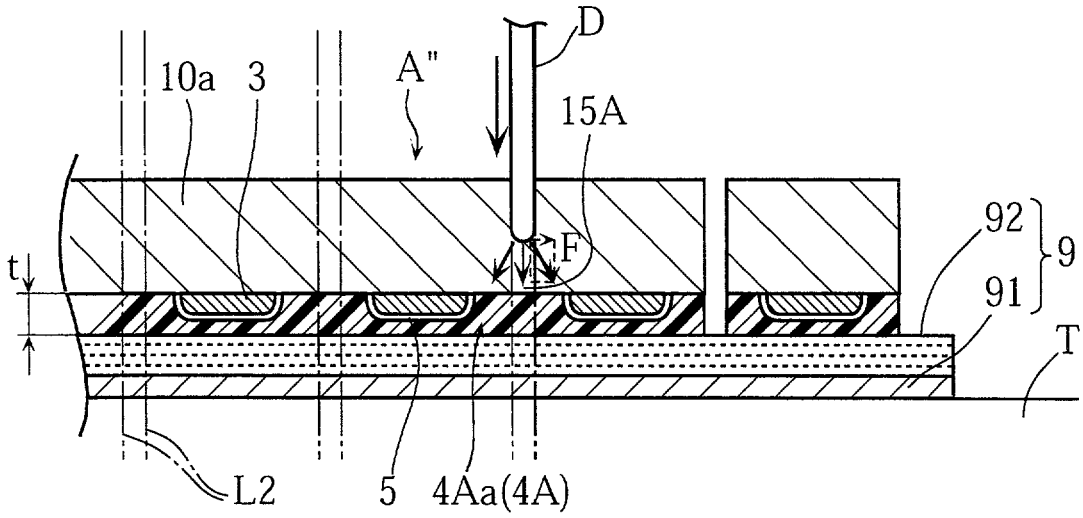
Figure 10B:
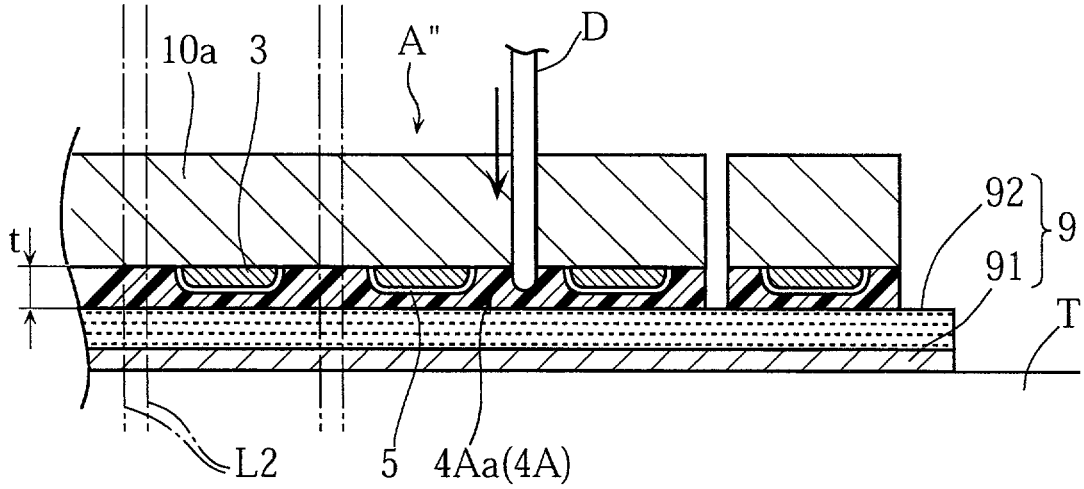
Figure 10C:
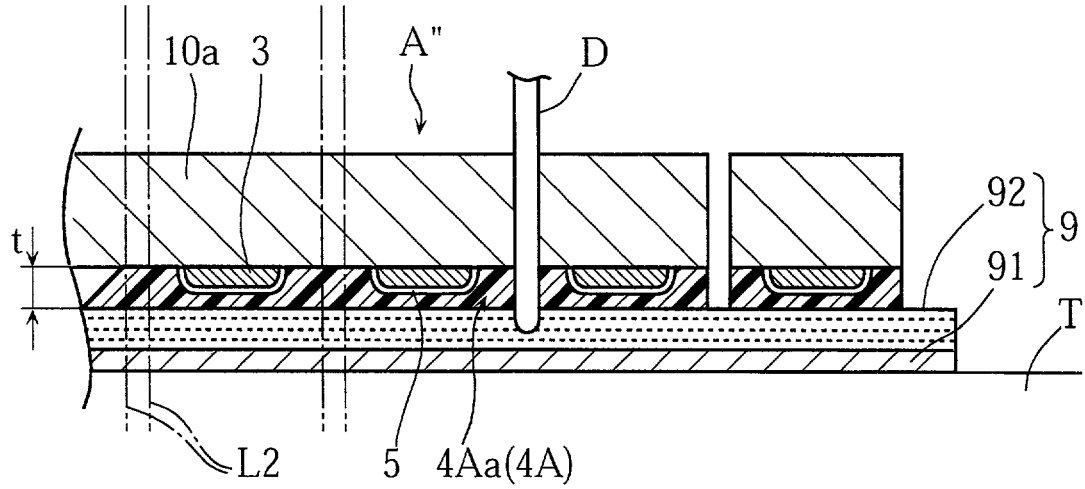

First, as shown in FIG. 10A, the intermediate form A" is turned upside down, and the resin layer 4Aa is attached to the adhesive sheet 9. This sheet is composed of a base 91 and an adhesive layer 92 provided on the base. The base 91 is fixed to a work table T. The base 91 has a thickness of about 50 μm, while the adhesive layer 92 has a thickness of about 80 μm. The adhesion of the adhesive layer 92 is great enough at room temperature so that the cutting of the substrate can be performed with high precision. After the cutting is over, the sheet 9 is heated up to a prescribed threshold temperature to weaken the adhesion of the adhesive layer 92. Thus, the individual chip is easily detached from the sheet 9 and moved to other locations by using a suction collet.

In the secondary cutting, the intermediate form A" is cut by the dicing cutter D from the substrate 10*a* toward the resin layer 4Aa. The dicing cutter D exerts forces of various directions on the substrate 10*a*. Among these forces is included a lateral force F, and in the prior art such a lateral force may break the substrate, as described with reference to FIGS. 14A and 14B. According to the embodiment of the present invention, on the other hand, the resin layer 4Aa is provided under the substrate 10, thereby maintaining the integrity of the substrate 10. Thus, when the substrate thickness at the cut site is reduced below the prior art critical value (25 μm), the breakage of the substrate 10 can be avoided.

After the substrate 10 is properly cut through, the dicing cutter D cuts the resin layer 4Aa. It should be noted here that no breakage will occur in the resin layer 4Aa during the cutting process. This is because the resin layer 4Aa is much softer than the substrate 10 and therefore no strong lateral force is exerted on the resin layer 4Aa.

Figure 11:
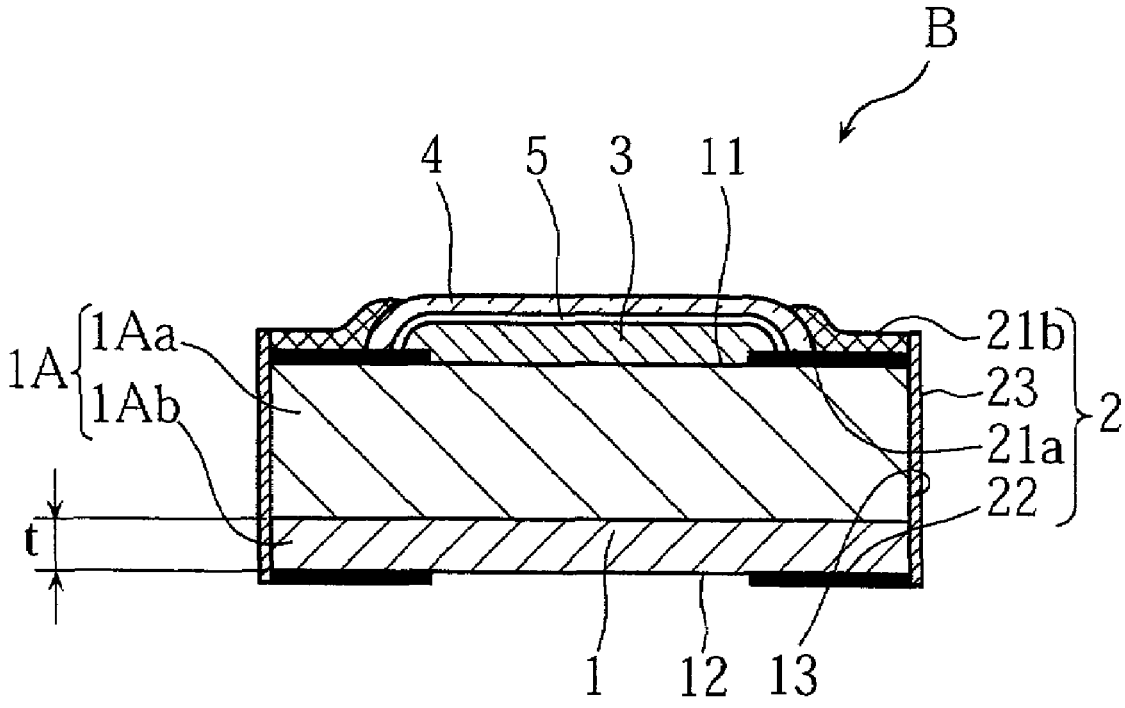
FIG. 11 is a sectional side view showing the basic structure of a chip resistor according to a second embodiment of the present invention.

FIG. 11 shows the basic structure of a chip resistor according to a second embodiment of the present invention. The resistor (generally indicated by the reference B) includes a two-layer substrate 1A, a pair of electrodes 2, a resistive layer 3, an overcoat 4 and an undercoat 5. Each of the electrodes 2 is composed of a first upper conductive layer 21*a*, a lower conductive layer 22, a second upper conductive layer 21*b* and a side conductive layer 23.

The substrate 1A is composed of a first layer 1Aa and a second layer 1Ab. These two layers are held in close contact with each other. The second layer 1Ab is made of a softer insulating material than the first layer 1Aa, so that it is more easily processed. Examples of such material are aluminum nitride, forsterite, etc. The Mohs hardness of these materials is about 7.0~7.5, which is smaller than that of alumina ceramic (about 8.5~9.0). The thickness t of the second layer 1Ab is about 20~100 μm (preferably 25~50 μm). The thickness of the substrate 1A as a whole is about 0.18 mm. In plan view, the substrate 1A is about 0.6 mm long and about 0.3 mm wide.

The chip resistor B may be fabricated in the following manner.

Figure 12:
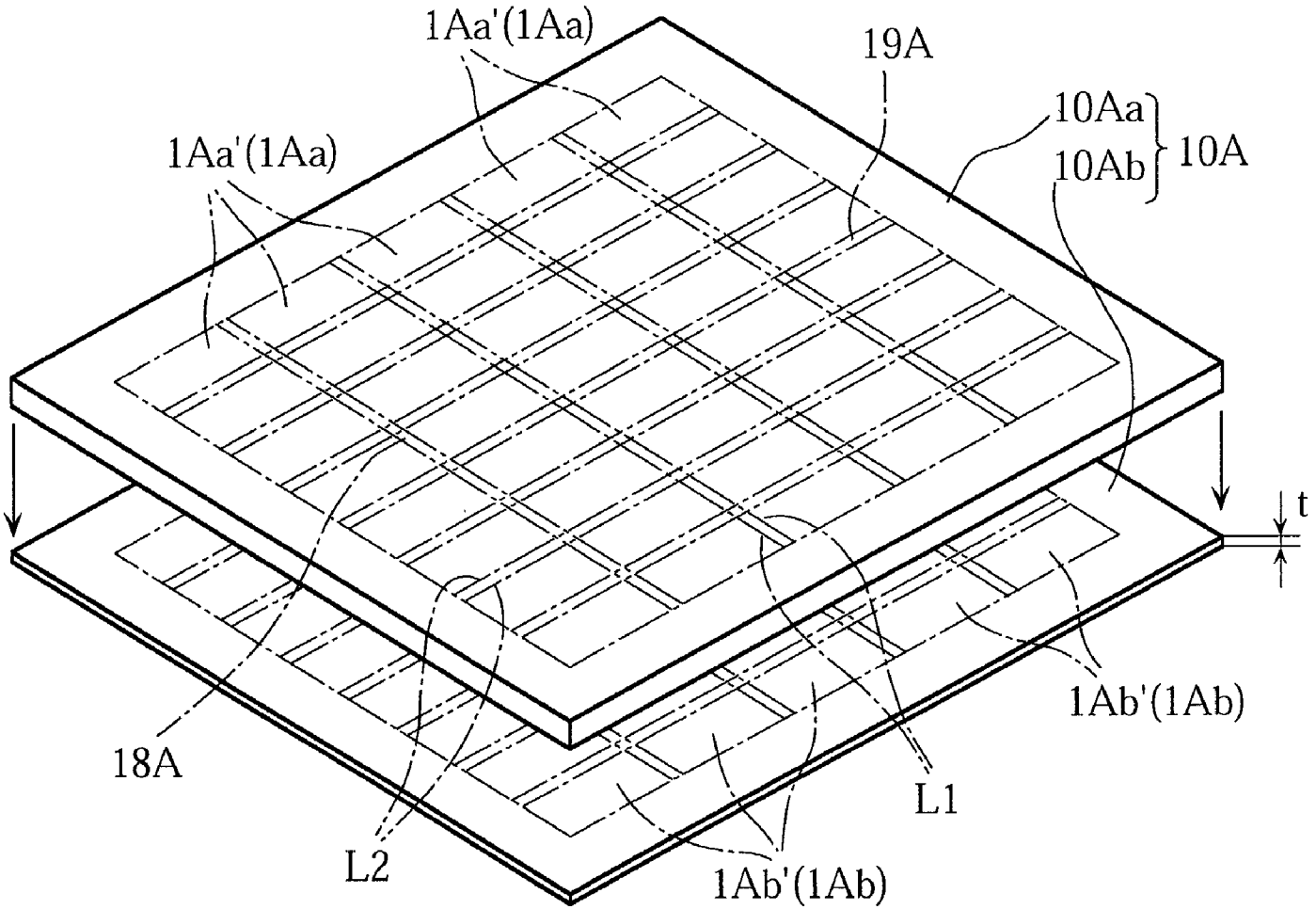
FIG. 12 is an exploded view showing two material plates used for collective formation of the resistor of FIG. 11.

First, as shown in FIG. 12, two material layers 10Aa and 10Ab are bonded to each other, to provide a mother substrate 10A. The upper or first material layer 10Aa is provided with a plurality of areas 1Aa' (corresponding to the element 1Aa shown in FIG. 11), while the lower or second material layer 10Ab is provided with the same number of areas 1Ab' (corresponding to the element 1Ab shown in FIG. 11). The second material layer 10Ab is easier to process than the first material layer 10Aa. The thickness of the second material layer 10Ab is about 20~100 μm (preferably 25~50 μm).

Figure 13:
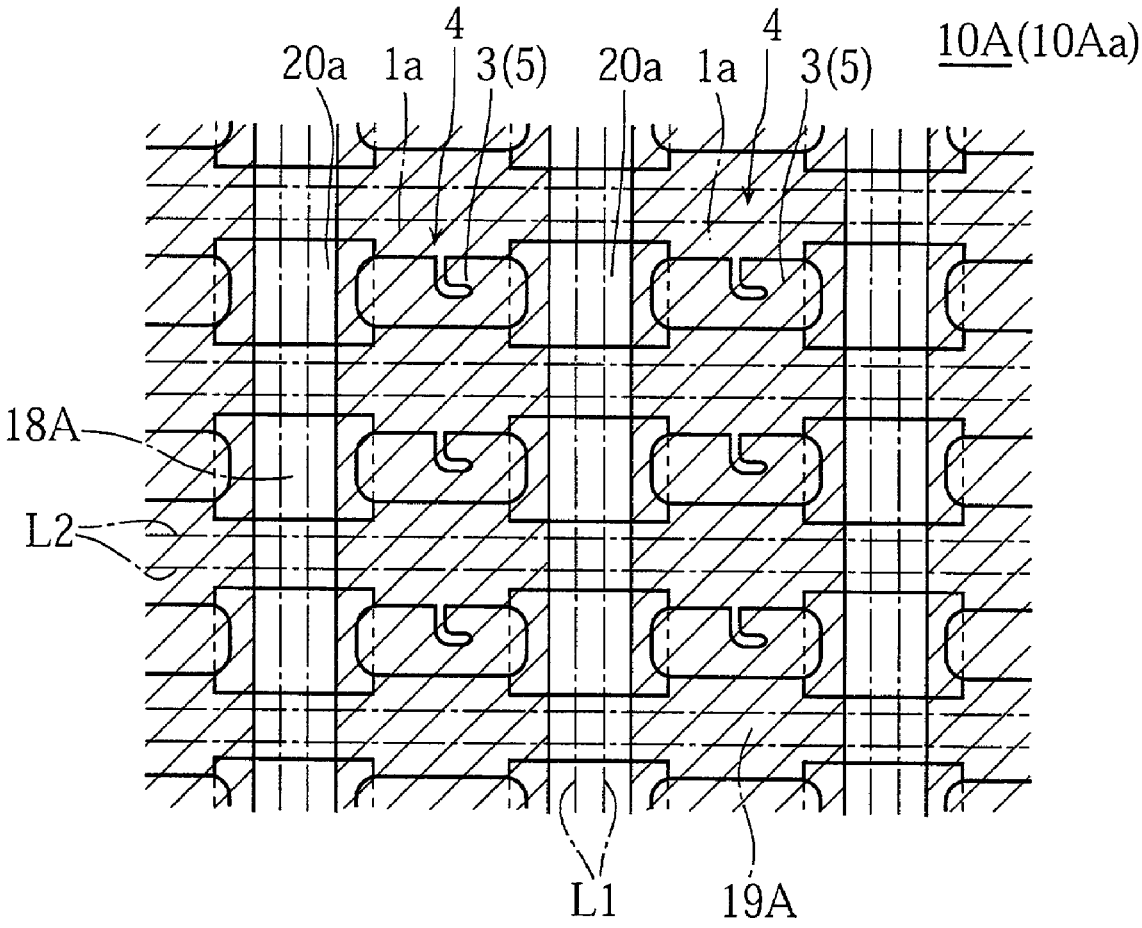
FIGS. 13, 14A-14C illustrate steps of a method of making the resistor of FIG. 11.

Then, as shown in FIG. 13, a conductive pattern is formed on the upper surface of the substrate 10A to provide a plurality of conductive pieces 20*a* (corresponding to the upper conductive layer 21*a*). Though not shown in the figures, a lower conductive pattern (corresponding to the lower conductive layer 21*b*) is formed on the lower surface of the substrate 10. The upper and the lower conductive patterns may be formed by using a screen printing technique for example.

Then, a resistive layer 3 is formed in each area 1Aa', and an undercoat 5 is formed to cover the resistive layer 3. Thereafter, the resistive layer 3 together with the undercoat 5 is subjected to laser trimming for resistance adjustment, as in the first embodiment.

Then, the mother substrate 10A is washed and dried. Then, several overcoat layers 4 are formed to cover the resistive layers 3. In the illustrated example, each overcoat layer 4 is elongated along the cut lines L1. The overcoat layer 4 may be made of glass (note that the overcoat 4A of the first embodiment is made of resin).

Then, as in the first embodiment, second upper conductive layers 21*b* are formed for each area 1Aa'. Thereafter, the mother substrate 10A is cut along the cut lines L1 (primary cutting), to provide an intermediate form like the one shown in FIG. 9. Then, a side conductive layer 23 is formed on each of the cut surfaces of the intermediate form.

Figure 14A:
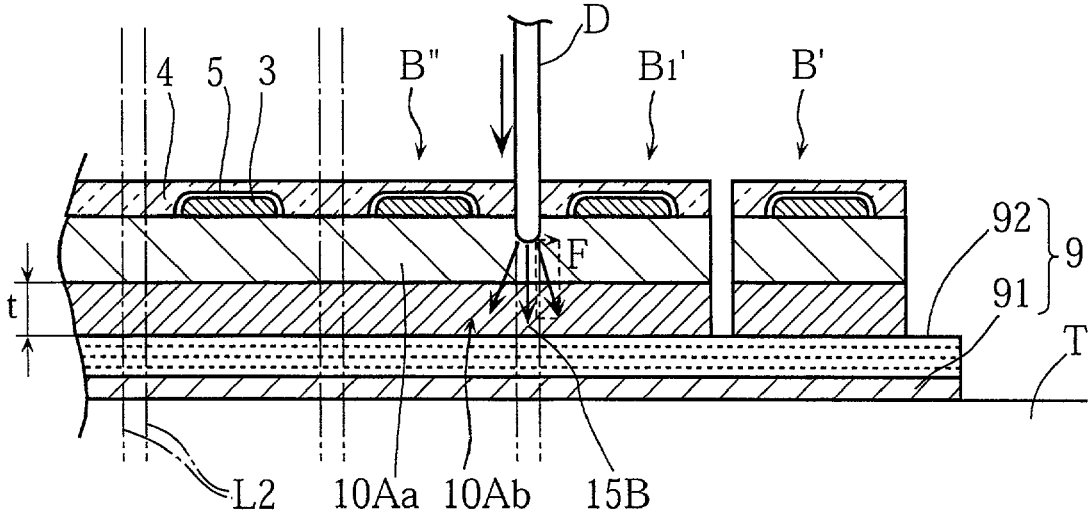
Figure 14B:
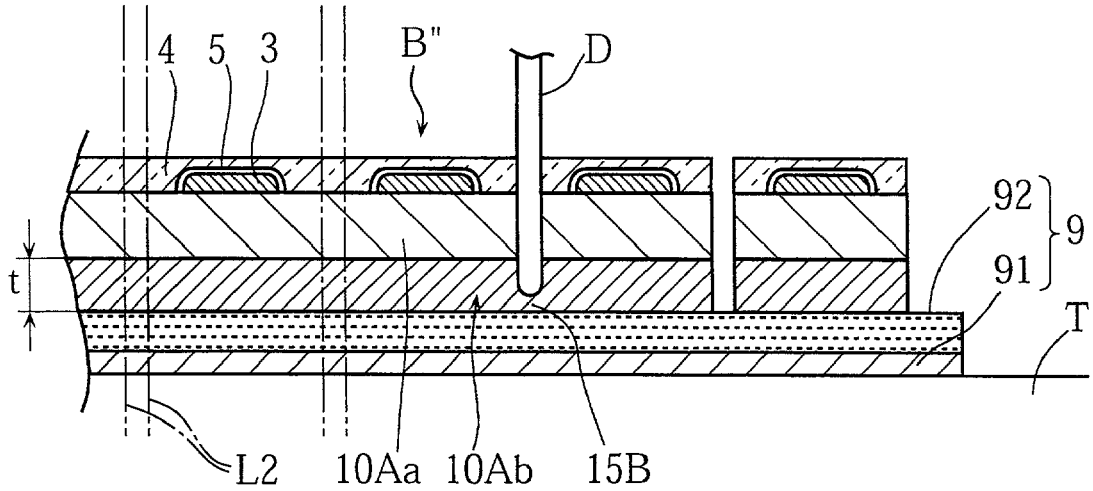
Figure 14C:
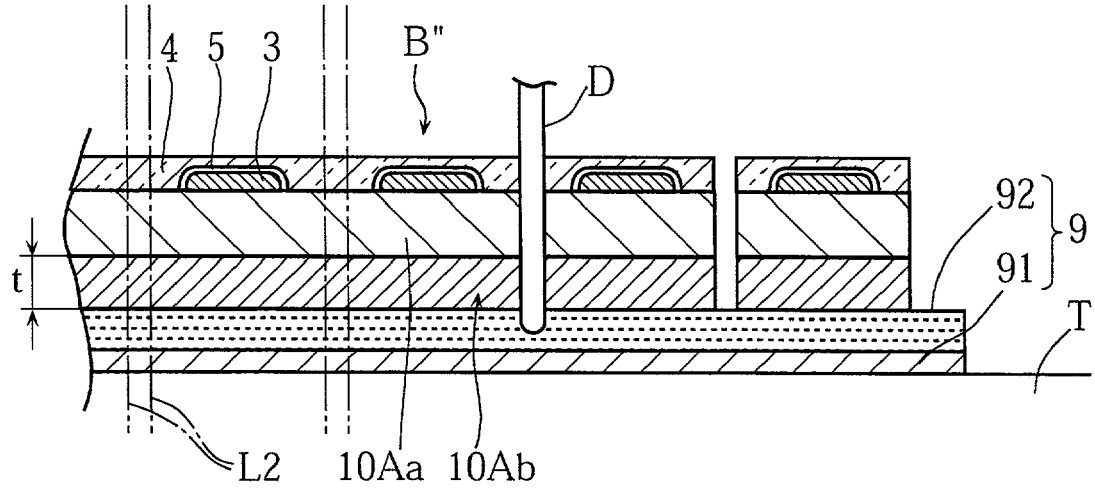

Then, as shown in FIGS. 14A~14C, the intermediate form B" is cut along the cut lines L2 (secondary cutting), to provide individual chips B'. Finally, the exposed portions of the second upper conductive layer 21*b*, the lower conductive layer 22 and the side conductive layer 23 are nickel-plated and solder-plated, to provide a chip resistor B (see FIG. 11).

In accordance with the second embodiment, as shown in FIG. 14A, the intermediate form B" is attached to the adhesive sheet 9 so that the first material layer 10Aa is positioned above the second material layer 10Ab. To cut the two-layer substrate, the dicing cutter D will penetrate through the overcoat layer 4, the first material layer 10Aa and the second material layer 10Ab in this order. As in the first embodiment, the lateral force F is exerted on the intermediate form B" due to the downward urging of the dicing cutter D. In the second embodiment, even if the force F acts on the first material layer 10Aa, the integrity of the layer 10Aa is maintained by the second material layer 10Ab, and therefore the first layer 10Aa will not break. Further, when the cutter D cuts the second layer 10Ab, the lateral force F is so small that the layer 10Ab will be properly cut through. This is because the second layer 10Ab is so soft that the downward urging force on the cutter D is mostly transmitted downward but hardly in the lateral direction.

Figure 15:
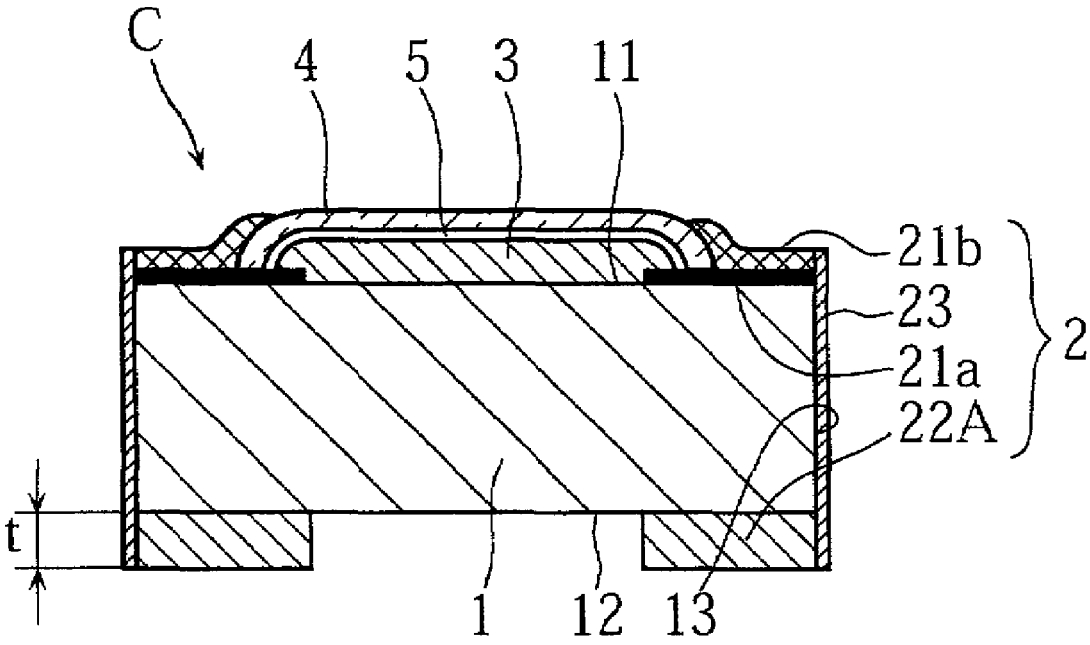
FIG. 15 is a sectional side view showing the basic structure of a chip resistor according to a third embodiment of the present invention.

FIG. 15 shows the basic structure of a chip resistor according to a third embodiment of the present invention. The resistor (generally indicated by the reference C) includes an alumina ceramic substrate 1, a pair of electrodes 2, a resistive layer 3, an overcoat 4 (made of glass) and an undercoat 5. Each of the electrodes 2 is composed of a first upper conductive layer 21*a*, a second upper conductive layer 21*b*, a lower conductive layer 22A and a side conductive layer 23.

The lower conductive layer 22A is made by printing and baking a conductive paste containing gold or silver. The thickness t of the layer 22A is about 20~100 μm (preferably 25~50 μm). The layer 22A is softer than the substrate 1, so that it can be readily processed.

To fabricate the chip resistor C, first a mother substrate 10 (see FIG. 16) is prepared. Then, an upper conductive pattern (which is to provide the first upper conductive layer 21*a*) is formed on the upper surface of the substrate 10 by a screen printing technique. It should be noted here that in FIG. 16 the substrate 10 is turned upside down so that the substrate's upper surface is invisible.

Figure 16:
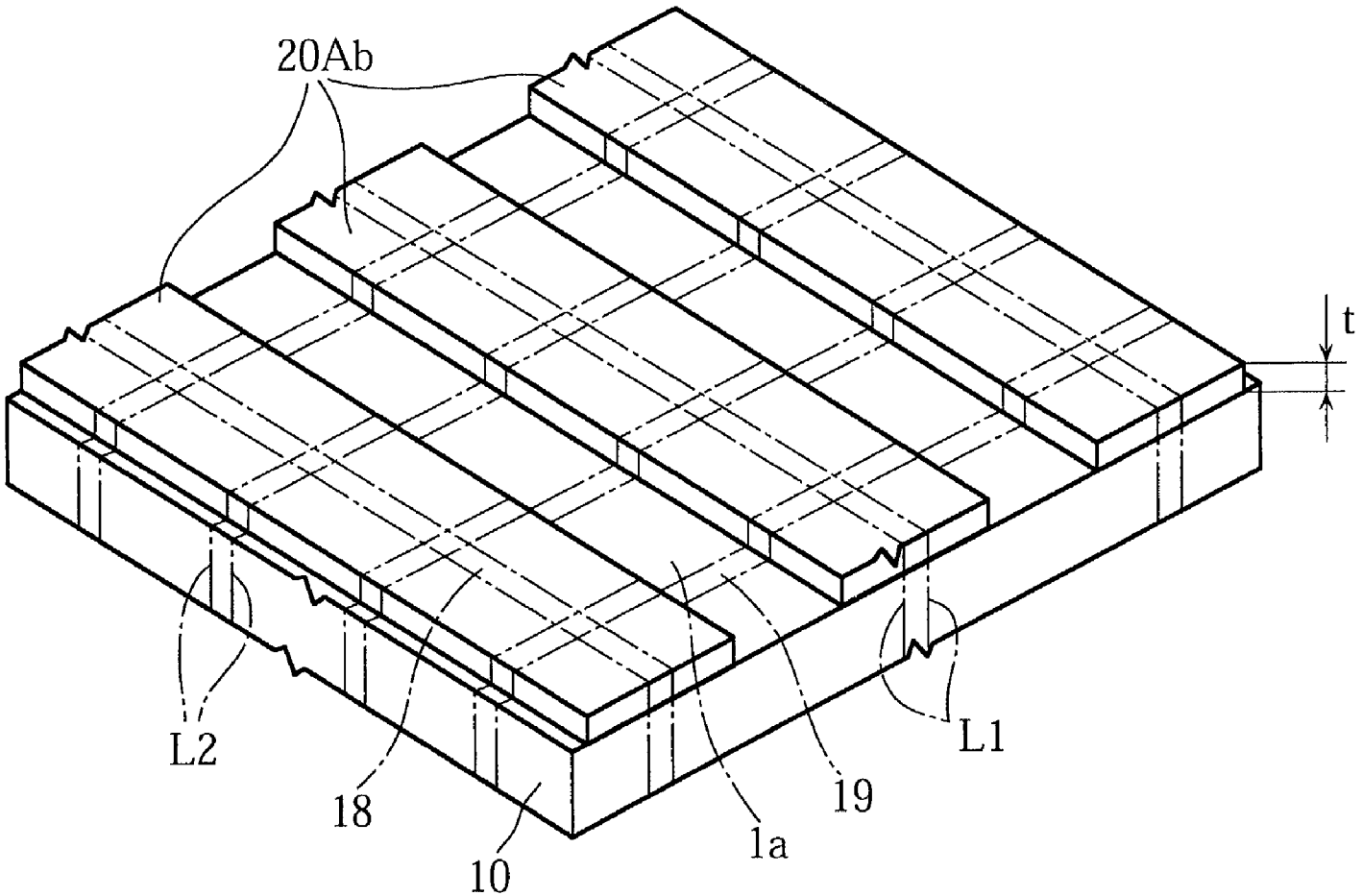
FIG. 16 is a perspective view showing the bottom side of a mother substrate used for collective formation of the resistor of FIG. 15.

Then, a lower conductive pattern is formed on the lower surface of the substrate 10. As shown in FIG. 16, the lower conductive pattern is composed of several conductive strips 20Ab elongated along the cut lines L1. The strip 20Ab corresponds to the lower conductive layer 22A shown in FIG. 15 and may be made by screen printing. The strip 20Ab has a thickness in a range of 20~100 μm (preferably 25~50 μm).

Then, a resistive layer 3 is formed in each area 1*a* and covered by an undercoat 5. The resistive layer 3, together with the undercoat 5, is subjected to laser trimming for resistance adjustment. These steps are the same as those of the first embodiment.

Then, the mother substrate 10A is washed and dried before an overcoat 4 is formed. These steps are the same as those of the second embodiment.

Then, second upper conductive layers 21*b* are formed for each area 1*a*, and thereafter the substrate 10 is divided along the cut lines L1, to provide intermediate forms like the one shown in FIG. 9. A side conductive layer 23 is formed on each of the cut surfaces of the intermediate form. These steps are the same as those of the first embodiment.

Figure 17A:
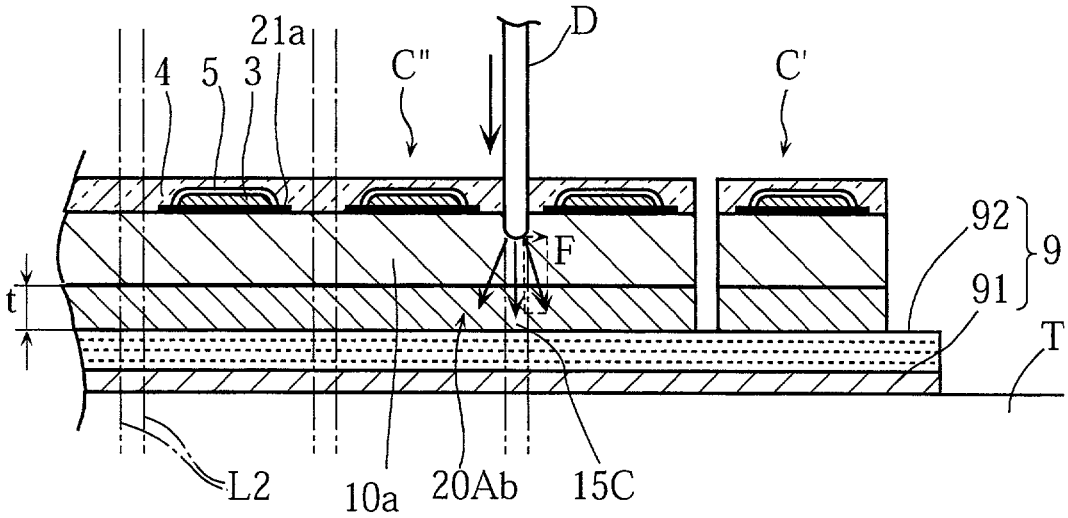
FIGS. 17A~17C illustrate steps of a method of making the resistor of FIG. 15.
Figure 17B:
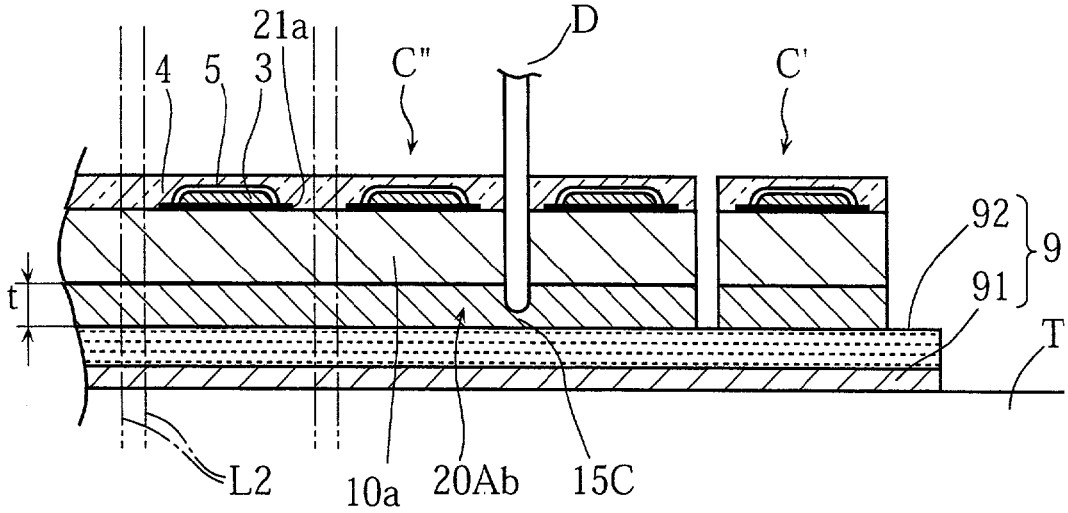
Figure 17C:
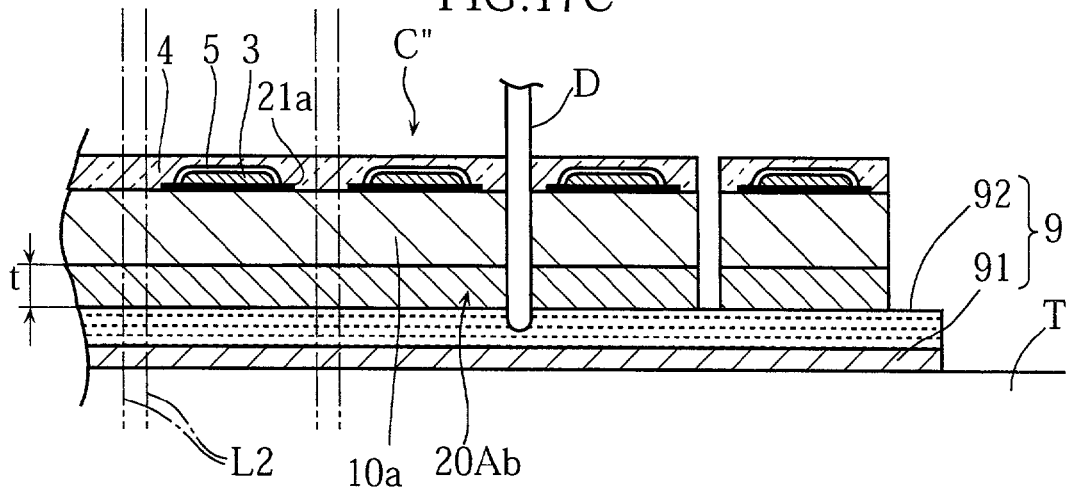
Figure 18:
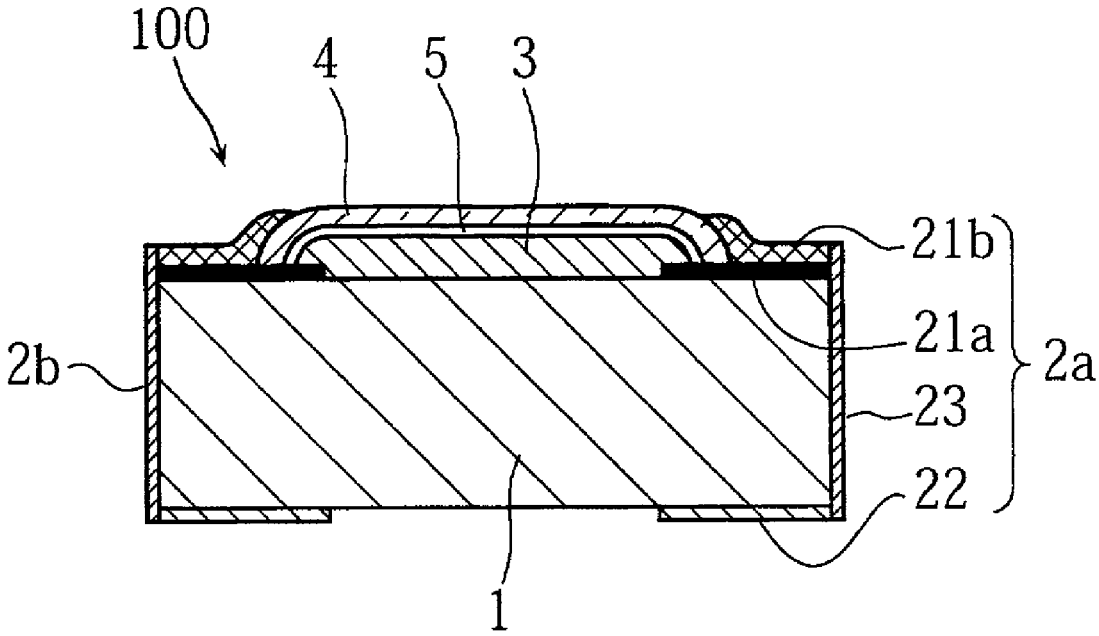
FIG.18 PRIOR ART
FIG. 18 is a sectional side view showing the basic structure of a conventional chip resistor.
Figure 19A:
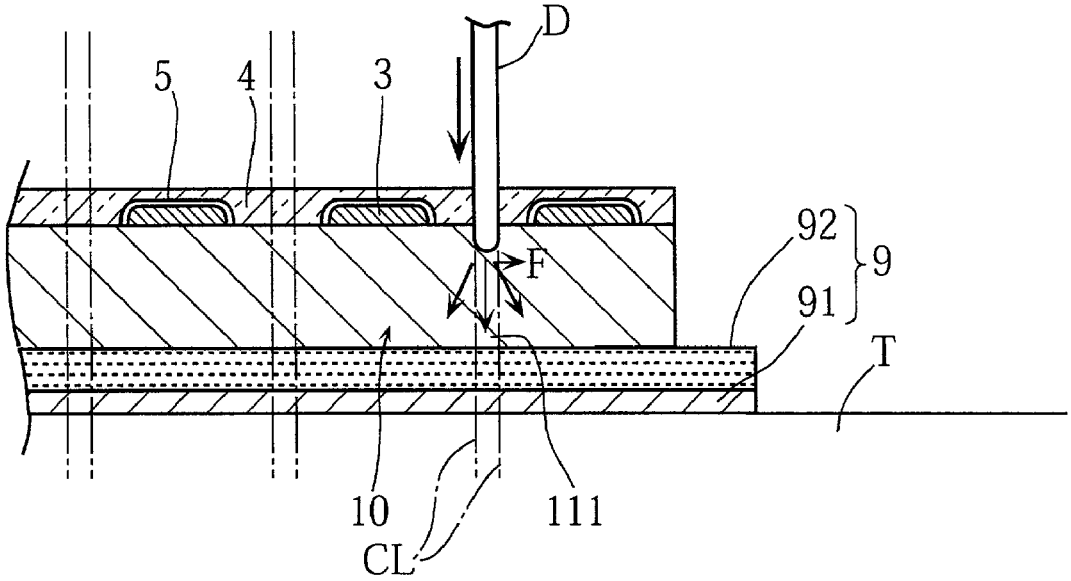
FIG.19A PRIOR ART
FIGS. 19A and 19B illustrate steps of a conventional method of making the resistor of FIG. 18.
Figure 19B:
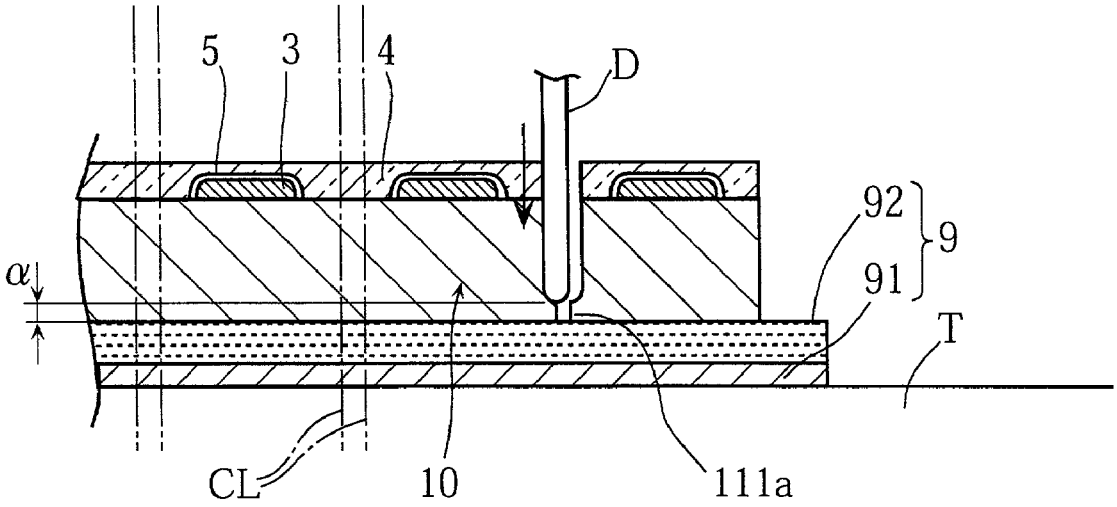
FIG.19B PRIOR ART

Then, as shown in FIGS. 17A~17C, the intermediate form C" is divided along the cut lines L2 (secondary cutting), to provide an individual chip C' for each area 1*a*. Finally, the chip C' is subjected to plating so that the exposed portions of the conductive layers 21*b*, 22 and 23 are nickel-plated and solder-plated. Thus, the chip resistor C shown in FIG. 15 is obtained.

To perform the secondary cutting, the intermediate form C" is attached to the adhesive sheet 9, with the conductive strip 20Ab disposed under the harder layer 10*a*. With this arrangement, the integrity of the upper layer 10*a* is maintained by the lower conductive strip 20Ab while the dicing cutter D is cutting the layer 10*a*. Following the layer 10*a*, the conductive strip 20Ab is to be cut. Advantageously, the lateral force F exerted by the cutter D is rendered so small due to the softness of the strip 20Ab that the force F does not break the strip 20Ab.

The present invention being thus described, it is obvious that the same may be varied in many ways. Such variations are not to be regarded as a departure from the spirit and scope of the present invention, and all such modifications as would be obvious to those skilled in the art are intended to be included within the scope of the following claims.

The invention claimed is:

1. A method of making a chip resistor comprising the steps of:

preparing a ceramic substrate that includes an upper surface and a lower surface opposite to the upper surface, the upper surface being provided with at least one row of resistive elements spaced from each other, with an upper conductive layer connected to the resistive elements and with a resin layer enclosing the resistive elements;

conducting primary cutting on the ceramic substrate to produce an intermediate form including an upper plane, a lower plane and a side plane extending between the upper plane and the lower plane, the upper plane corresponding to a part of the upper surface of the ceramic substrate, the lower plane corresponding to a part of the lower surface of the ceramic substrate the side plane being a cut surface resulting from the primary cutting, the upper plane being provided with the at least one row of resistive elements the upper conductive layer, and the resin layer;

forming a side conductive layer on the side plane of the intermediate form, the side conductive layer being connected to the upper conductive layer; and conducting secondary cutting on the intermediate form and the side conductive layer and then the resin layer, the secondary cutting proceeding from the lower plane toward the upper plane of the intermediate form in a manner such that the side conductive layer is cut simultaneously with the intermediate form;

wherein the resin layer is smaller in thickness than the substrate.

2. The method according to claim 1, wherein the resin layer has a thickness in a range of 20~100 μm.

3. The method according to claim 1, further comprising the step of attaching the resin layer to an adhesive sheet before the secondary step.

4. The method according to claim 1, wherein the intermediate form is an elongated rectangular parallelepiped, and wherein the secondary cutting is performed along a cut line extending transversely to a longitudinal direction in which the intermediate form is elongated.

5. The method according to claim 4, wherein the resin layer is spaced apart from the side plane of the intermediate form.

6. The method according to claim 1, further comprising the step of forming a glass undercoat covering the resistive elements, the undercoat being disposed between the resistive elements and the resin layer.

* * * * *